US008532551B2

(12) United States Patent
Tetsuno et al.

(10) Patent No.: US 8,532,551 B2
(45) Date of Patent: Sep. 10, 2013

(54) IMAGE FORMING APPARATUS

(75) Inventors: Shuichi Tetsuno, Numazu (JP); Kenichi Ogawa, Kawasaki (JP); Masashi Tanaka, Susono (JP); Takaaki Akamatsu, Suntou-gun (JP); Shogo Kan, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 13/094,028

(22) Filed: Apr. 26, 2011

(65) Prior Publication Data

US 2011/0268481 A1 Nov. 3, 2011

(30) Foreign Application Priority Data

Apr. 30, 2010 (JP) ..... 2010-105347

(51) Int. Cl.
*G03G 15/20* (2006.01)

(52) U.S. Cl.
USPC ..... 399/327

(58) Field of Classification Search
USPC ..... 399/327; 219/216
See application file for complete search history.

(56) References Cited

U.S. PATENT DOCUMENTS

| | | | | |
|---|---|---|---|---|
| 2004/0126158 | A1* | 7/2004 | Toyoda et al. | 399/327 |
| 2009/0257793 | A1* | 10/2009 | Yoshioka et al. | 399/321 |
| 2010/0260523 | A1* | 10/2010 | Nishida et al. | 399/327 |
| 2011/0268482 | A1* | 11/2011 | Akamatsu et al. | 399/327 |
| 2013/0064583 | A1* | 3/2013 | Yoshida et al. | 399/327 |

FOREIGN PATENT DOCUMENTS

| | | | |
|---|---|---|---|
| JP | 3-58074 | A | 3/1991 |
| JP | 5-158375 | A | 6/1993 |
| JP | 7-129017 | A | 5/1995 |
| JP | 8-152808 | A | 6/1996 |
| JP | 2000-47509 | A | 2/2000 |
| JP | 2000-122463 | A | 4/2000 |
| JP | 2009-271517 | A | 11/2009 |

* cited by examiner

*Primary Examiner* — G. M. Hyder
(74) *Attorney, Agent, or Firm* — Fitzpatrick, Cella, Harper & Scinto

(57) ABSTRACT

An image forming apparatus is capable of setting a cleaning mode in which a fixing portion is cleaned by a cleaning sheet while nip-conveying the cleaning sheet in a fixing nip. When the cleaning mode is set, an image forming apparatus provides a period in which a first rotatable member and a second rotatable member are rotated in a state in which a heater is controlled so that a surface temperature Th of the first rotatable member immediately after passing through the fixing nip is kept within a temperature range of Th≦Tf3, wherein Tf3 is a flow start point of a toner and so that a surface temperature Tp of the second rotatable member immediately after passing through the fixing nip is within a temperature range Tf2≦Tp≦Tf3, wherein Tf2 is a deformation end point of the toner.

4 Claims, 5 Drawing Sheets

(a)

(b)

(a)

(b)

IMAGE FORMING APPARATUS

FIELD OF THE INVENTION AND RELATED ART

The present invention relates to an image forming apparatus such as an electrophotographic copying machine or an electrophotographic printer.

In the image forming apparatus of an electrophotographic type, such as the copying machine or the printer, a fixing device for fixing an unfixed toner image, which has been transferred onto a recording material such as transfer paper or an OHP sheet at an image forming portion, on the recording material is mounted. As a type of the fixing device, a heating roller type including a fixing roller and a pressing roller and a film heating type including a fixing film and the pressing roller have been known. In the fixing device of these types, a pressing member such as the pressing roller is contacted to a rotatable fixing member such as a heated fixing roller or a heated fixing film and the unfixed toner image is heated and melted while nip-conveying the recording material carrying the unfixed toner image, thus being heat-fixed on the recording material. In the fixing device, it is ideal that a whole toner of the unfixed toner image carried on the recording material is heat-melted by the rotatable fixing member to be heat-fixed on the recording material.

However, in the fixing device, with respect to the unfixed toner image, the toner which has not been completely melted and the toner which has been excessively melted are offset from a toner image carrying surface of the recording material onto an outer peripheral surface of the rotatable fixing member in some cases. The toners which are offset from the recording material surface onto the rotatable fixing member surface cause contamination of the rotatable fixing member surface. Further, the toners which are offset from the recording material surface onto the rotatable fixing member surface are transferred from the rotatable fixing member surface onto an outer peripheral surface of the pressing member, thus causing contamination of the pressing member surface.

In order to prevent deposition of the toner on the rotatable fixing member surface and the pressing member surface, at the rotatable fixing member surface and the pressing member surface, a layer of fluorine-containing resin such as PTFE, PFA or FEP is provided in general in view of a parting property of the toner. Alternatively, a parting layer of silicone rubber such as LTV or RTV is generally provided. However, there is cause where it is difficult to prevent the toner deposition only by a function of such a parting layer. For example, in the case where calcium carbonate ($CaCO_3$) is used in a large amount as a filler for the recording material (transfer paper), calcium carbonate is deposited together with the fibers of paper on the rotatable fixing member surface and the pressing member surface to lower the parting property of the toner from the surfaces, so that the toner is liable to be deposited on the surfaces. When the toner is deposited on the rotatable fixing member surface and the pressing member surface, the surface parting property is further lowered. For that reason, the fixing device is caught in a vicious cycle such that the fibers of paper, calcium carbonate and the toner are increasingly deposited on the rotatable fixing member surface and the pressing member surface, so that the toner, the fibers of paper and calcium carbonate are gradually accumulated as contaminants on the rotatable fixing member surface and the pressing member surface in some cases. When an amount of accumulation of the contaminants is increased, a part of the contaminants can be removed and thus can be transferred from the rotatable fixing member surface and the pressing member surface onto the recording material surface, so that image defects can occur. Further, when a ratio of the contaminants on the rotatable fixing member surface and the pressing member surface is increased, winding of the recording material about the rotatable fixing member and the pressing member can occur, thus leading to a problem such as jam.

Further, in the fixing devices of the heating roller type and of the film heating type, the contaminant is liable to be accumulated on the pressing member surface compared with the rotatable fixing member surface. In the fixing devices, the unfixed toner image is fixed on the recording material during printing and therefore the rotatable fixing member surface contacted to the image carrying surface of the recording material is set at a temperature which is not less than a softening point of the toner. For this reason, the toner offset and deposited on the rotatable fixing member surface during a preceding printing is heated up to a temperature which is not less than the softening point during a current print and therefore the toner is substantially discharged on the recording material surface when the recording material is passed through the fixing nip during the current printing. Further, paper powder such as the fibers of paper and calcium carbonate which have been deposited on the rotatable fixing member surface is also discharged on the recording material in the form such that the paper powder is deposited on the toner which has been discharged from the rotatable fixing member surface onto the image carrying surface of the recording material. For that reason, the contaminant is less liable to be accumulated on the rotatable fixing member surface.

On the other hand, the pressing member surface is not contacted to the image carrying surface of the recording material and therefore the temperature of the pressing member surface is not necessarily required to be increased up to the temperature which is not less than the softening point of the toner even during printing. Further, also from the viewpoint of energy saving, it is desirable that the temperature of the pressing member surface is not increased more than necessary, so that the temperature of the pressing member surface during printing is not more than the softening point of the toner in many cases. For that reason, the toner deposited on the pressing member surface is less liable to be heated up to the temperature which is not less than the softening point of the toner, so that an adhesive force of the toner to the recording material becomes small. Therefore, even when the recording material is passed through (introduced into) the fixing nip between the rotatable fixing member surface and the pressing member surface during the print, the toner on the pressing member surface is not readily discharged onto a non-image carrying surface (back surface) of the recording material. Further, the toner on the pressing member surface is less liable to be discharged on the back surface of the recording material and therefore the paper powder is less liable to be discharged onto the back surface of the recording material in the form such that the paper powder is deposited on the toner. For that reason, the toner and the paper powder are liable to remain on the pressing member surface while the paper powder is deposited on the toner, so that the contaminant resulting from the toner and the paper powder is liable to accumulated on the pressing member surface.

With respect to the contaminant on the pressing member surface, in Japanese Laid-Open Patent Application (JP-A) 2000-047509, a cleaning means for holding a solid white recording material which does not carry the toner image and for conveying the recording material while repeating rotation and stop of the rotation has been proposed. Particularly, during the stop of the rotation, the temperature of the pressing member surface is increased up to the temperature which is not less than the softening point of the toner, so that the toner contained in the contaminant on the pressing member surface is heated up to the temperature which is not less than the softening point thereof. As a result, the adhesive force of the contaminant to the recording material is increased and thus the surface contaminant of the pressing member is liable to be discharged onto the recording material, so that the contaminant on the pressing member surface can be removed efficiently.

As the recording material used in the image forming apparatus in which the above-described fixing device is mounted, transfer paper containing paper powder in a large amount is used in some cases. In these cases, a contaminant in which a toner ratio is small and a paper powder ratio is large can be deposited on the pressing member surface of the fixing device. In the case where the ratio of the toner contained in the contaminant deposited on the pressing member surface is small, even when a viscosity of the toner contained in the contaminant is increased by heating the toner contained in the contaminant up to the temperature which is not less than the softening point of the toner, the viscosity of the contaminant is still small as a whole. For that reason, the adhesive force of the contaminant, deposited on the pressing member surface, to the back surface of the recording material cannot be obtained sufficiently, so that it is difficult to transfer the contaminant from the pressing member surface onto the back surface of the recording material. When a paper powder rich contaminant in which the paper powder ratio is larger than the toner ratio is accumulated on the pressing member surface, the parting property at the pressing member surface is largely lowered, so that the offset toner deposited on the rotatable fixing member is to be transferred onto the pressing member surface in a large amount. As a result, the toner is deposited as the contaminant on the pressing member surface in the large amount, so that the contaminant can be discharged onto the back surface of the recording material and the winding of the recording material about the recording material surface can occur.

Further, when the fixing device is actuated without performing maintenance of the fixing device for a long term while the paper powder rich contaminant is deposited on the pressing member surface, the rotatable fixing member surface is worn by friction thereof with the paper powder rich contaminant on the pressing member surface. As a result, in some cases, the parting property at the rotatable fixing member surface is lowered and the rotatable fixing member is damaged. When the parting property at the rotatable fixing member surface is lowered, the toner is liable to be offset onto the rotatable fixing member surface. Thus, there are possibilities that image defect occurs due to the offset, that the contaminant is accumulated on the rotatable fixing member surface and that the contaminant is accumulated on the pressing member surface by the transfer of the toner from the rotatable fixing member surface onto the pressing member surface. Further, when the recording material on which the unfixed toner image is carries is passed through (introduced into) the fixing nip, the damage on the rotatable fixing member surface is transferred to the unfixed toner image, so that there is a possibility of an occurrence of image defects.

SUMMARY OF THE INVENTION

A principal object of the present invention is to provide an image forming apparatus capable of removing a contaminant, in which a paper powder ratio is larger than a toner ratio, from a pressing member (second rotatable member).

According to an aspect of the present invention, there is provided an image forming apparatus comprising:

an image forming portion for forming an unfixed toner image on a recording material; and a fixing portion for heat-fixing the unfixed toner image on the recording material while nip-conveying the recording material in a fixing nip, the fixing portion including a heater, a first rotatable member contactable to the unfixed toner image, and a second rotatable member contacted to the first rotatable member to form the fixing nip between itself and the first rotatable member, wherein the image forming apparatus is capable of setting a cleaning mode in which the fixing portion is cleaned by a cleaning sheet while nip-conveying the cleaning sheet in the fixing nip, wherein when the cleaning mode is set, the image forming apparatus provides a period in which the first rotatable member and the second rotatable member are rotated in a state in which the heater is controlled so that a surface temperature Th of the first rotatable member immediately after passing through the fixing nip is kept within a temperature range of $Th \leqq Tf3$ wherein Tf3 is a flow start point of the toner and so that a surface temperature Tp of the second rotatable member immediately after passing through the fixing nip is within a temperature range $Tf2 \leqq Tp \leqq Tf3$ wherein Tf2 is a deformation end point of the toner, and wherein after a lapse of the period, the cleaning sheet is conveyed in the fixing nip.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Part (a) of FIG. 1 is a schematic structural view of an example of an image forming apparatus according to Embodiment 1, and (b) of FIG. 1 is a schematic structural view of an example of a fixing device.

Part (a) of FIG. 2 is an illustration showing a toner deformation start point and a toner deformation end point which are measured by a flow tester, and (b) of FIG. 2 is an illustration showing a toner flow start point, a toner softening point and a toner flow end point which are measured by the flow tester.

Figure 3:
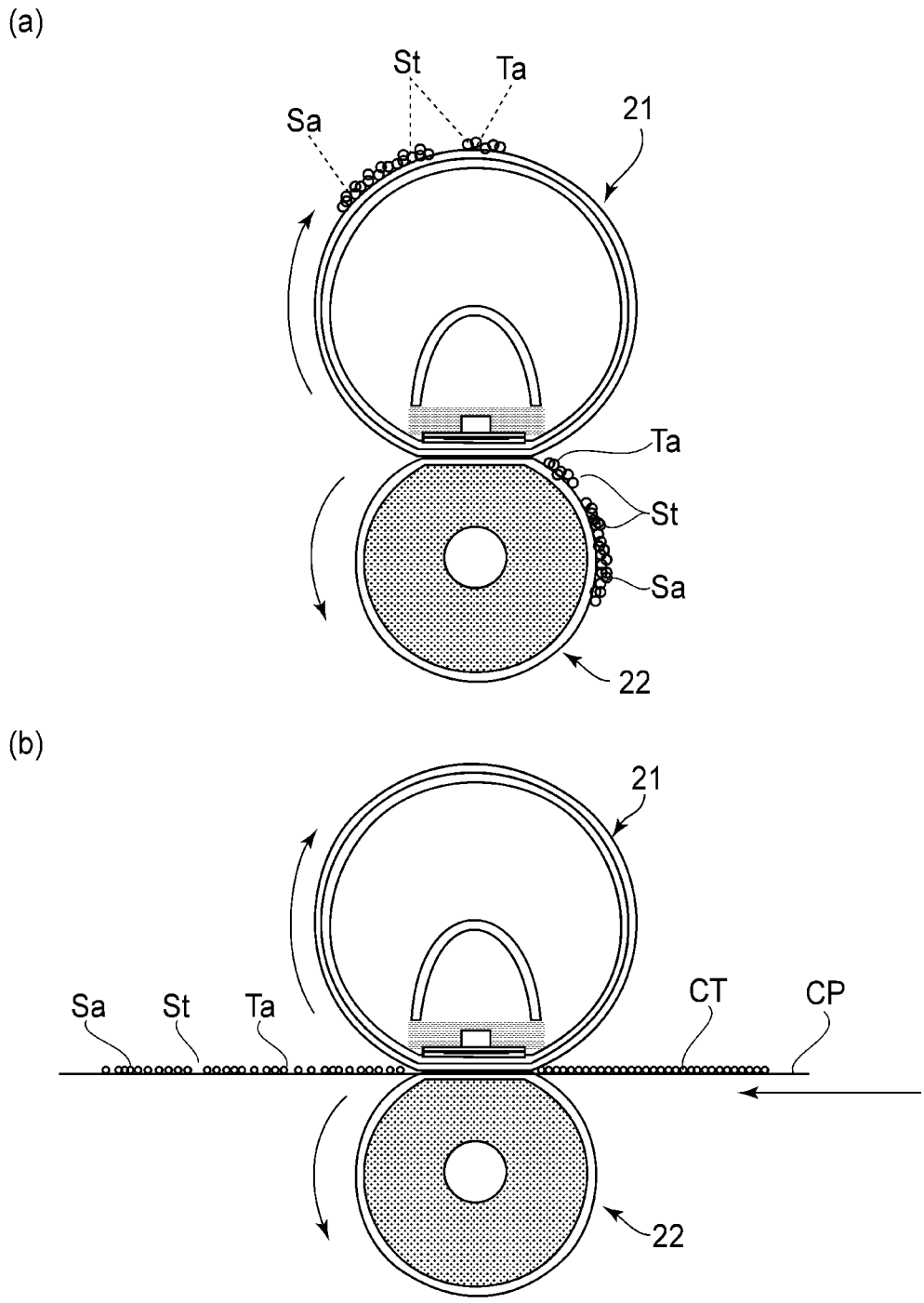

Parts (a) and (b) of FIG. 3 are illustrations showing a removing process for a paper powder rich contaminant on a pressing roller surface during execution of a cleaning mode, wherein (a) is an illustration showing a process in which the paper powder rich contaminant is transferred from the pressing roller surface onto a fixing film surface and (b) is an illustration showing a process in which the paper powder rich contaminant is transferred from the fixing film surface onto a recording material surface.

Figure 4:
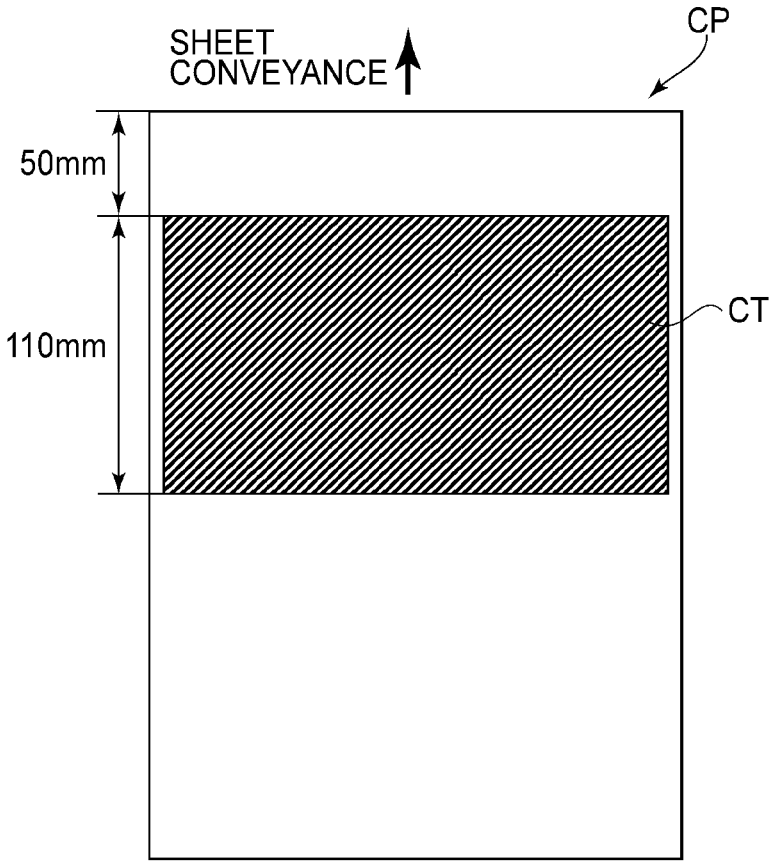

FIG. 4 is a top view of an example of cleaning paper on which an unfixed toner image pattern for cleaning is formed.

Figure 5:
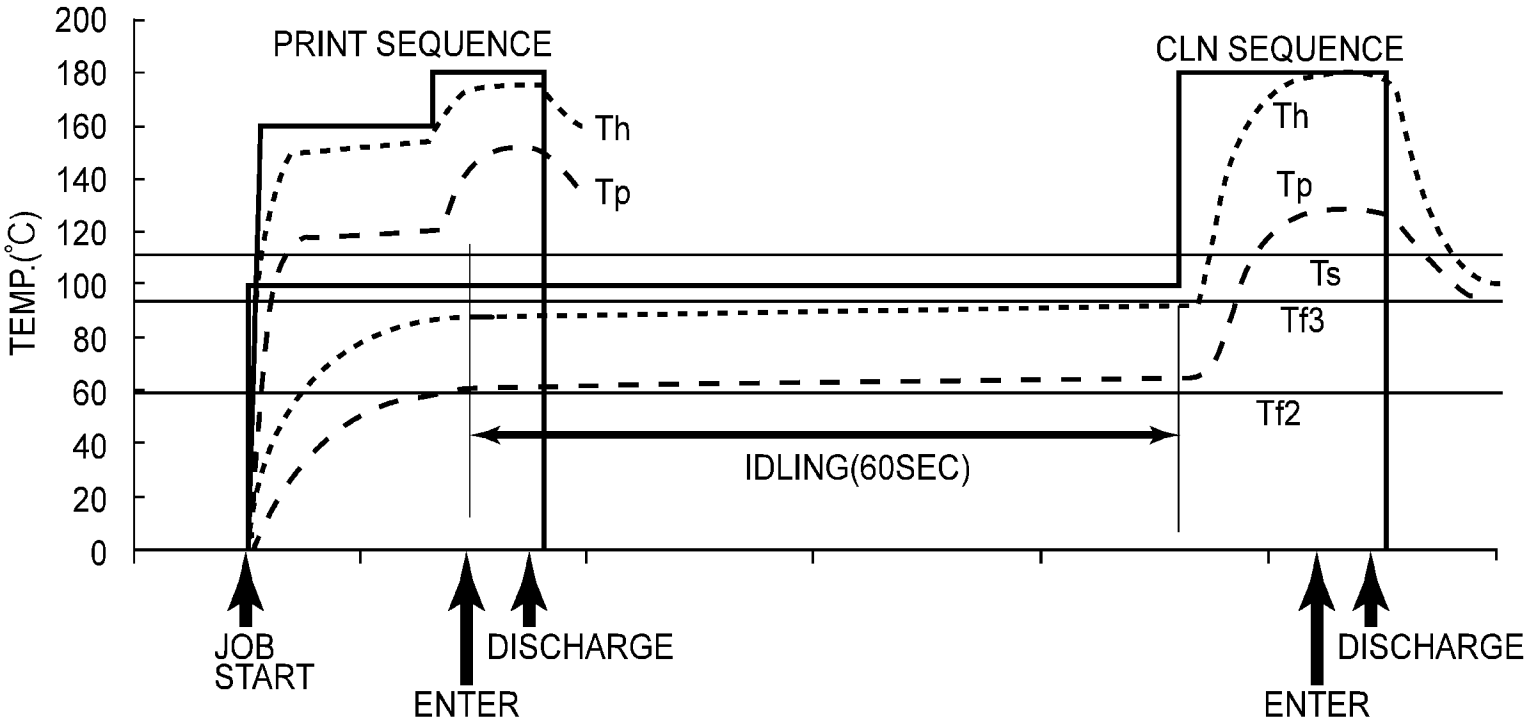

FIG. 5 is a time chart showing progression of a target temperature, a fixing film temperature and a pressing roller temperature during execution of the cleaning mode.

DESCRIPTION OF THE PREFERRED EMBODIMENTS

Embodiment 1

Figure 1:
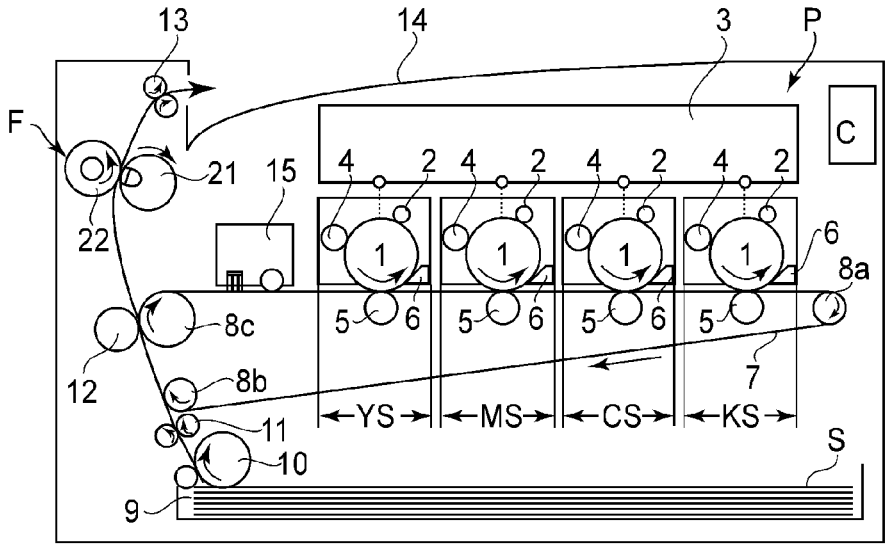
Figure 1:
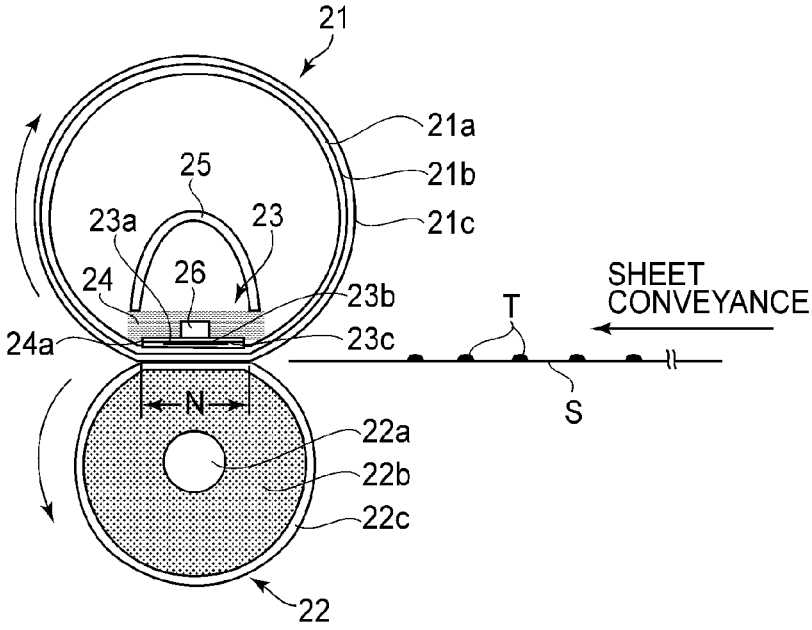

FIG. 1 is a schematic structural view of an example of an image forming apparatus according to this embodiment of the present invention. This image forming apparatus is a full-color laser (beam) printer for forming an image on a recording material such as transfer paper or an OHP sheet by utilizing electrophotography.

The image forming apparatus in this embodiment includes roughly classified three portions consisting of an image forming portion P for forming an unfixed toner image on a recording material S, a fixing portion for heat-fixing the unfixed toner image on the recording material S (hereinafter referred to as a fixing device), and a control portion (controller) C for controlling the image forming portion P, the fixing device F and the like. The image forming portion P includes four image forming stations YS, MS, CS and KS. Of the four image forming stations, the image forming station YS forms an image of yellow (Y) and the image forming station MS forms an image of magenta (M). Further, the image forming station CS forms an image of cyan (C) and the image forming station KS forms an image of black (K). Each of the image forming stations YS, MS, CS and KS includes a drum-type electrophotographic photosensitive member 1 as an image bearing member (hereinafter referred to as a photosensitive drum) and a charging roller 2 as a charging means. Further, each of the image forming apparatus YS, MS, CS and KS includes an exposure device 3 as an exposure means, a developing device 4 as a developing means, a primary transfer roller 5 as a primary transfer member, a drum cleaner 6 as a cleaning means, and the like. The controller C includes a CPU and memories such as ROM and RAM. In the memories, information on an image formation control sequence and a cleaning mode and various tables and programs which are necessary for the image formation control sequence and the cleaning mode are stored. The controller C executes the image formation control sequence depending on a print instruction (job) outputted from an external device (not shown) such as a host computer and controls the image forming portion P and the fixing device F in accordance with the image formation control sequence.

In the image forming apparatus in this embodiment, when the image formation control sequence is executed, the photosensitive drum 1 is rotated in an arrow direction at the image forming station YS. First, an outer peripheral surface of the photosensitive drum 1 is uniformly charged to a predetermined potential and a predetermined polarity by the charging roller 2 (charging step). Then, the charged surface of the photosensitive drum 1 is irradiated with laser light, by the exposure device 3, depending on image information (image data) inputted from the external device, so that the charged surface of the photosensitive drum 1 is exposed to light and thus an electrostatic latent image (electrostatic image) is formed on the surface of the photosensitive drum 1 (exposure step). This latent image is visualized into Y toner image with Y toner by the developing device 4. As a result, the Y toner image is formed on the surface of the photosensitive drum 1 (developing step). Also at the image forming stations Ms, Cs and KS, a similar image forming process including the charging step, the exposure step and the developing step is performed. As a result, an M toner image, a contact toner image and a K toner image are formed on the photosensitive drums 1 at the image forming stations MS, CS and KS, respectively. An endless intermediary transfer belt 7 as a toner image conveying member provided along an arrangement direction of the image forming stations YS, MS, CS and KS is stretched around a driving roller 8*a*, a follower roller 8*b* and a secondary transfer opposite roller 8*c*. The intermediary transfer belt 7 is rotated in an arrow direction along the image forming stations YS, MS, CS and KS at a peripheral speed of 120 mm/sec by the driving roller 8. Onto the outer peripheral surface of the intermediary transfer belt 7, the color toner images are successively transferred supposedly by primary transfer rollers 5 provided to oppose the photosensitive drums 1 while sandwiching the intermediary transfer belt 7 (primary transfer step). As a result, unfixed toner images for a four-color based full-color image are carried on the surface of the intermediary transfer belt 7. After the primary transfer, untransferred toner remaining on the surface of each of the photosensitive drums 1 is removed by an associated drum cleaner 6 and then each photosensitive drum 1 is subjected to subsequent image formation.

On the other hand, the recording material S stacked and accommodated in a feeding cassette 9 provided below the intermediary transfer belt 7 is separated and fed one by one from the feeding cassette 9 by a feeding roller 10 and then is fed to a registration roller pair 11. The registration roller pair 11 sends the fed recording material S into a secondary transfer nip between the intermediary transfer belt 7 and a secondary transfer roller 12 provided to oppose the secondary transfer opposite roller 8*c* while sandwiching the intermediary transfer belt 7. The recording material S is nip-conveyed in the secondary transfer nip by the surface of the intermediary transfer belt 7 and the outer peripheral surface of the secondary transfer roller 12. In this conveyance process, the unfixed toner images on the intermediary transfer belt 7 surface are transferred onto the recording material S by the secondary transfer roller 12 and are kept in that state (secondary transfer step). The recording material S which carries the unfixed toner images is introduced into a fixing nip N, which will be described later, of the fixing device F. The recording material S is passed through the fixing nip N, so that the unfixed toner images are subjected to heat and pressure to be heated-fixed on the surface of the recording material S. The recording material S is conveyed from the fixing device F to discharging rollers 13 and is discharged on a discharge tray 14 by the discharging rollers 13. Untransferred toner remaining on the intermediary transfer belt 7 after the secondary transfer is removed by a belt cleaner 15 as an image conveying member cleaning means. Then, the intermediary transfer belt 7 is subjected to subsequent image formation.

(2) Fixing Device (Fixing Portion)

Part (b) of FIG. 1 is a schematic structural view of an example of the fixing device F in this embodiment. The fixing device F is of a film heating type. With respect to the fixing device F and constituent elements constituting the fixing device F, a longitudinal direction is a direction perpendicular to a recording material (sheet) conveyance direction in a plane of the recording material S. A widthwise direction is a direction parallel to the recording material conveyance direction in the plane of the recording material S. A width is a dimension with respect to the widthwise direction. With respect to the recording material S, a longitudinal direction is a direction parallel to the recording material conveyance direction in the plane of the recording material S. A widthwise direction is a direction perpendicular to the recording material conveyance direction in the plane of the recording material S. A length is a dimension with respect to the longitudinal direction.

The fixing device F in this embodiment includes a fixing film (endless belt) 21 as a first rotatable member, a pressing roller 22 as a second rotatable member, a ceramic heater 23 as a heating member, and the like. An outer diameter of the fixing film 21 formed in a cylindrical shape is about 18 mm. The fixing film 21 includes a cylindrical polyimide base layer 21*a* which has flexibility and heat resistance and has the outer diameter of 18 mm. On an outer peripheral surface of the polyimide base layer 21*a*, an approximately 200 μm-thick elastic layer 22*b* of a silicone rubber is provided and thereon, a 15 μm-thick parting layer 22*c* of PFA is provided.

On an inner peripheral surface of the fixing film 21, a heater 23, a heater holder 24 for supporting the member 23, and a pressing stay 25 for supporting the heater holder 24 and for pressing the inner peripheral surface of the fixing film 21 are disposed. The heater 23 includes an elongated heat-resistant member substrate 23*a* formed of a material such as aluminum nitride or alumina. On the surface (toward the fixing nip N) of the heater substrate 23*a*, a resistor pattern 23*b* as a heat generating resistance layer which generates heat by energization is formed along a longitudinal direction of the heater substrate 23*a* by printing. The resistor pattern 23*b* is coated with a glass layer 23*c* as a protective layer provided on the surface of the heater substrate 23*a*. On a back surface (opposite from the fixing nip N) of the member substrate 23*a*, a thermistor 26 as a temperature detecting member is provided at a position corresponding to a longitudinal central portion of the resistor pattern 23*b* on the surface of the heater substrate 23*a*. At a widthwise central position of a lower surface (toward the fixing nip N) of the heater holder 24 formed of heat-resistant resin, a groove 24*a* is provided along the longitudinal direction of the heater holder 24. In the groove 24*a* of the heater holder 24, the heater substrate 23*a* of the heater 23 is fixed and supported in a state in which the glass layer 23*c* is exposed from an opening of the groove 24*a*. The heater holder 24 is supported vertically movably by a device frame (not shown) of the fixing device F at longitudinal and portions thereof. The pressing stay 25 formed of metal provided on an upper surface (opposite from the fixing nip N) of the heater holder 24 is supported vertically movably by the device frame at longitudinal end portions thereof.

The pressing roller 22 formed in a cylindrical shaft shape includes a core metal 22*a* formed of stainless steel in an outer diameter of 13 mm. On the outer peripheral surface of the core metal 22*a*, an about 3.5 mm-thick elastic layer 22*b* formed of a silicone rubber is provided and thereon, an about 30 μm-thick parting layer of PFA is provided. The pressing roller 22 is disposed under the fixing film 21 so that the surface thereof opposes the surface of the fixing film 21. The pressing roller 22 is rotatably supported by the device frame at longitudinal end portions thereof through bearings (not shown). The bearings for the pressing roller 22 are urged in a radial direction of the fixing film 21 by urging springs (not shown) and the pressing stay 25 is urged at its longitudinal end portions in the radial direction of the pressing roller 22 by urging springs (not shown). By urging forces of these urging springs, the surface of the pressing roller 22 urged toward the heater substrate 23*a* of the heater 23 via the fixing film 21. As a result, the elastic layer 22*b* of the pressing roller 22 is elastically deformed along the longitudinal direction of the heater 23 to form the fixing nip N with a predetermined width between the surface of the fixing film 21 and the surface of the pressing roller 22.

(Heat-Fixing Operation of Fixing Device)

Depending on a print instruction, the pressing roller 22 is rotated in an arrow direction at a predetermined peripheral speed (process speed). The rotation of the pressing roller 22 is transmitted to the surface of the fixing film 21 by a frictional force between the surface of the pressing roller 22 and the surface of the fixing film 21 in the fixing nip N. As a result, the fixing film 21 is rotated in an arrow direction at a predetermined peripheral speed (process speed) by the rotation of the pressing roller 22 while sliding on the surface of the glass layer 23*c* of the heater 23 at the inner surface thereof. Further, depending on the print instruction, a triac (not shown) as an energization control circuit is turned on, so that energy is supplied to the resistor pattern 23*b* of the heater 23. As a result, the resistor pattern 23*b* generates heat, so that the heater 23 is quickly increased in temperature to heat the fixing film 21. The temperature of the heater 23 is detected by the thermistor 26. On the basis of an output signal from the thermistor 26 (hereinafter referred to as a thermistor detection temperature), the triac is subjected to ON/OFF control so that the temperature of the heater 23 is kept at a predetermined temperature-control temperature (target temperature). In this embodiment, the temperature-control temperature is set at 170° C. When the pressing roller 22 is rotated and the temperature of the heater 23 is kept at the temperature-control temperature, the recording material S carrying thereon the unfixed toner images is introduced into the fixing nip N. The recording material S is nipped and conveyed in the nipped state by the fixing film 21 and the pressing roller 22 in the fixing nip N. In this conveyance process, the unfixed toner images T are heat-fixed on the recording material S by being subjected to heat of the fixing film 21 and pressure of the pressing roller 22. Then, the recording material S on which the unfixed toner images T are heat-fixed is separated from the surface of the fixing film 21 and is discharged from the fixing nip N.

The image forming apparatus in this embodiment is capable of setting a cleaning mode in which the fixing portion is cleaned while nip-conveying a cleaning sheet in the fixing nip N. When the cleaning mode is set, the image forming apparatus provides a period in which the first rotatable member and the second rotatable member are rotated in a state in which the heater is controlled so that a surface temperature Th of the first rotatable member immediately after passing through the fixing nip is kept within a temperature range of $Th \leqq Tf3$ wherein Tf3 is a flow start point of the toner and so that a surface temperature Tp of the second rotatable member immediately after passing through the fixing nip is within a temperature range $Tf2 \leqq Tp \leqq Tf3$ wherein Tf2 is a deformation end point of the toner. After a lapse of the period, the cleaning sheet is conveyed in the fixing nip.

First, the flow start point, the deformation end point and the like of the toner will be described.

(Thermodynamic Properties of Toner)

In this embodiment, toner A constituted by a binder resin of polyester and a crystalline max of paraffin was used. The toner A has thermodynamic properties including a deformation start point (Tf1), a deformation end point (Tf2), a flow start point (Tf3), a flow end point (Tf4) and a softening point (Ts). The toner A has the deformation start point (Tf1) of about 42° C., the deformation end point (Tf2) of about 62° C., the flow start point (Tf3) of about 93° C., the flow end point (Tf4) of about 141° C. and the softening point (Ts) of about 117° C.

The deformation start point (Tf1) and the deformation end point (Tf2) of the toner A will be described. The deformation start point (Tf1) of the toner A is a temperature at which the toner starts its deformation when the toner is placed in a hermetically sealed container and then the temperature of the toner is gradually increased while applying certain pressure to the toner. Then, the toner is continuously deformed by further increasing the temperature of the toner A but the deformation of the toner is stopped at a certain temperature. Even when the temperature of the toner is further increased, the toner is not substantially deformed. The temperature at which the deformation of the toner A is stopped is the deformation end point (Tf2) of the toner A. Specifically, measurement is performed in the following manner. First, when a true density of the toner A is ρ (g/cm$^3$), (0.16×ρ) g of the toner A is weighed and placed in a pressure molding machine and is subjected to pressure molding for 2 minutes under a load of 1960 N (200 kgf) in a normal temperature and normal humidity environment to prepare a columnar sample of about 8 mm in diameter and about 2 mm in height. Then, at a central portion of a polished bottom of a cylindrical container of about 10 mm in inner diameter and 200 mm or more in inner wall height, the columnar sample is placed. Further, a pressing jig of about 9.9 mm in outer diameter and 10 mm in thickness is contacted to the sample. In this state, the sample is held at 35° C. for 5 minutes. Thereafter, a load of 98 N (10 kgf) is applied to the pressing jig and the columnar sample is increased in temperature up to 120° C. at a temperature rise rate of 1° C./min., and then an amount of displacement of the pressing jig contacted to the sample is measured. At that time, a temperature at which the pressing jig starts its displacement is the deformation start point (Tf1) of the toner A. Further, a temperature at which an increase in amount of displacement of the pressing jig which has started its displacement is stopped is the deformation end point (Tf2).

In this embodiment, the above measurement was performed by a flow tester ("CFT-100D", mfd. by Shimadzu Corp.). An example of the measurement result is shown in (a) of FIG. 2. In the graph, an ordinate represents the amount of displacement (stroke) of the pressing jig and an abscissa represents the temperature of the toner A. As shown in (a) of FIG. 2, from the deformation start point (Tf1) to the deformation end point (Tf2) of the toner A, the amount of displacement of the toner A is abruptly increased. This is because rigidity of the toner A is abruptly lowered between the deformation start point (Tf1) and the deformation end point (Tf2). This is attributable to an occurrence of glass transition of an amorphous component of the toner A. A temperature at which the amorphous component of the toner A starts the glass transition is in the neighborhood of the deformation start point (Tf1). A temperature at which the glass transition of the amorphous component of the toner A is substantially entirely ended is in the neighborhood of the deformation end point (Tf2). When the temperature of the toner A is not less than the deformation end point (Tf2), the glass transition of the amorphous component is ended and therefore the rigidity of the toner A is not lowered, so that the amount of displacement of the pressing jig is also not increased.

The flow start point (Tf3) and the flow end point (Tf4) of the toner A will be described. The flow start point (Tf3) of the toner A is a temperature at which the toner starts its flowing out through a hole when the toner is placed in a hermetically sealed container except that a bottom of the container is provided with the hole, and then the temperature of the toner is gradually increased while applying certain pressure to the toner. Then, the toner is continuously flows out by further increasing the temperature of the toner A but the toner completely flows out at a certain temperature. The temperature at which the toner A completely flows out in the flow end point (Tf4) of the toner A. Specifically, measurement is performed in the following manner. First, (0.96×ρ) g of the toner A is weighed and placed in a pressure molding machine and is subjected to pressure molding for 2 minutes under a load of 1960 N (200 kgf) in a normal temperature and normal humidity environment to prepare a columnar sample of about 10 mm in diameter and about 12 mm in height. Then, at a central portion of a polished bottom, provided with a cylindrical hole of 1 mm in diameter and 0.5 mm in thickness, of a cylindrical container of about 10 mm in inner diameter and 200 mm or more in inner wall height, the columnar sample is placed. Further, a pressing jig of about 9.9 mm in outer diameter and 10 mm in thickness is contacted to the sample. In this state, the sample is held at 35 40$^{C}$ for 5 minutes. Thereafter, a load of 98 N (10 kgf) is applied to the pressing jig and the columnar sample is increased in temperature up to 200° C. at a temperature rise rate of 4° C./min., and then an amount of displacement of the pressing jig contacted to the sample is measured. At that time, a temperature at which the toner A flows out through the hole provided at the bottom of the cylindrical container and the pressing jig starts its displacement is the flow start point (Tf3) of the toner A. Further, a temperature at which the pressing jig does not cause its displacement by completion of the entire flowing out of the toner from the cylindrical container is the flow end point (Tf4).

In this embodiment, the above measurement was performed by the flow tester ("CFT-100D", mfd. by Shimadzu Corp.). An example of the measurement result is shown in (b) of FIG. 2. In the graph, an ordinate represents the amount of displacement (stroke) of the pressing jig and an abscissa represents the temperature of the toner A. As shown in (b) of FIG. 2, from the flow start point (Tf3) to the flow end point (Tf4) of the toner A, the amount of displacement of the toner A is abruptly increased. This is because flowability of the toner A is abruptly increased from the flow start point (Tf3). This is attributable to an occurrence of fusion of a crystalline component of the toner A. A temperature at which the crystalline component of the toner A starts the fusion is in the neighborhood of the flow start point (Tf3) of the toner. A temperature at which the fusion of the crystalline component of the toner A is ended is in the neighborhood of the flow end point (Tf4) of the toner. The softening point (Ts) of the toner A is a just middle temperature between the flow start point (Tf3) of the toner A and the flow end point (Tf4) of the toner A. In this state, the crystalline component of the toner A is fused (melted) to some extent and has the flowability. For this reason, when the temperature of the toner A is not less than the softening point (Ts), the toner A has a large adhesive force to the recording material S.

Figure 2:
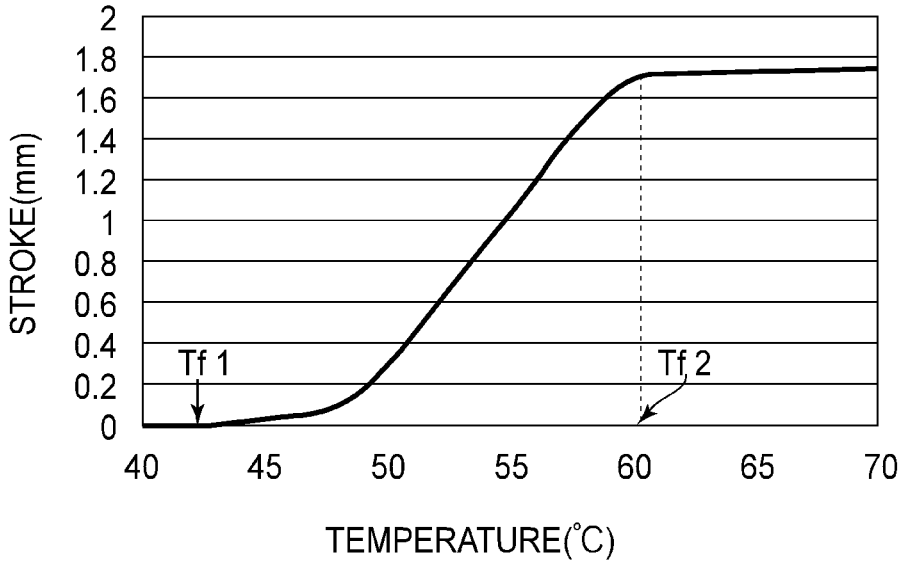
Figure 2:
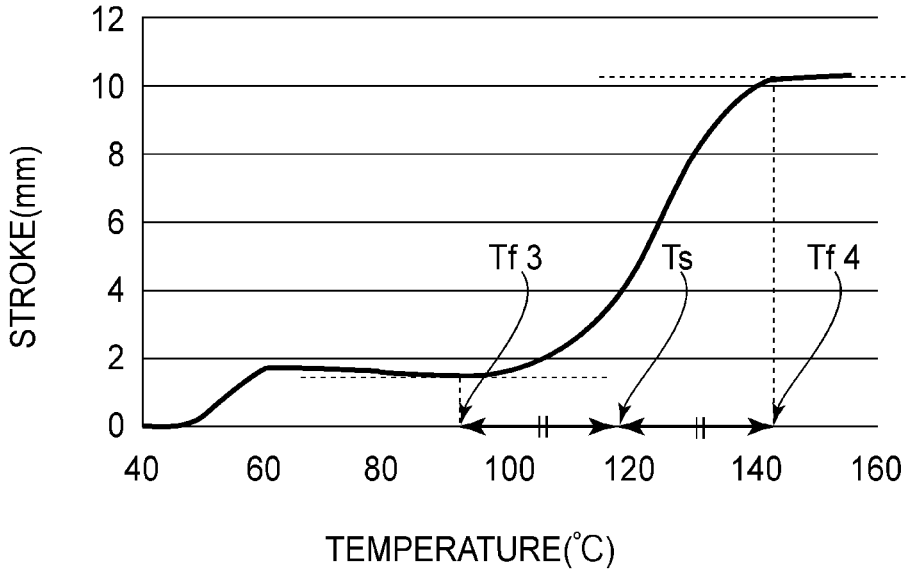

As is understood from the above description with reference to (a) and (b) of FIG. 2, with respect to the toner, among the deformation start point (Tf1), the deformation end point (Tf2), the flow start point (Tf3), the flow end point (Tf4) and the softening point (Ts), the following relationship is satisfied.

$$Tf1<Tf2<Tf3<Ts<Tf4$$

(Cleaning Mode)

The cleaning mode is executed when a user provides an instruction to effect cleaning from, e.g., a personal computer or when the user selects the cleaning mode by an operation of a switch provided to the image forming apparatus.

When the cleaning mode is set (selected), first, the image forming apparatus is left standing until the thermistor detection temperature is a normal temperature (30° C. or less), so that the surface temperature of the pressing roller 22 is cooled to the normal temperature. Then, at a temperature-control temperature (target control temperature of the heater 23) of 100° C., the fixing film 21 is subjected to idling at a rotational speed of 50 mm/sec for 60 sec. A period of the idling corresponds to a period in which the fixing film 21 and the pressing roller 22 are rotated in a state in which a surface temperature Th of the fixing film 21 is kept within a temperature range of Th≦Tf3 (Tf3: toner flow start point) and a surface temperature Tp of the pressing roller 22 is kept within a temperature range of Tf2≦Tp≦Tf3 (Tf2: toner deformation end point). In the case of the image forming apparatus in this embodiment, the temperature ranges of Th≦Tf3 and Tf2≦Tp≦Tf3 can be kept by rotating the fixing film 21 and the pressing roller 22 in a state in which the temperature of the heater 23 is kept at 100° C.

Then, the temperature-control temperature is changed to 170° C. while keeping the rotational speed of the fixing film 21 at 50 mm/sec, and immediately thereafter the recording material is passed through the fixing nip N. In the case of the image forming apparatus in this embodiment, when the temperature of the heater 23 is changed to 170° C., the surface temperature Th of the fixing film 21 can be made the toner state Ts or more. On the surface of the recording material to be contacted to the fixing film 21, an unfixed toner image for cleaning is carried. The unfixed toner image for cleaning is formed by the image forming portion P after setting of the cleaning mode.

FIG. 5 is a time chart showing progression of the target temperature and the surface temperatures of the fixing film and the pressing roller in the cleaning mode (CLN sequence). The time chart also shows progression of those during normal image formation (print sequence) for reference.

FIG. 4 shows an example of the recording material on which an unfixed toner image for cleaning are carried. In order to differentiate the recording material from the recording material S used in the normal image formation, the recording material carrying thereon the unfixed toner image for cleaning is referred to as cleaning paper CP.

As shown in FIG. 4, an unfixed toner image CT for cleaning is carried on the cleaning paper CP substantially over an entire area at a part of the surface of the cleaning paper CP with respect to a widthwise direction perpendicular to the recording material (sheet) conveyance direction. The image carrying area of the unfixed toner image CT for cleaning has a length, with respect to the recording material conveyance direction, which is one full circumference or more of the fixing film 21. In this embodiment, the unfixed toner image CT for cleaning is carried in the image carrying area ranging from a first position from a leading end of the cleaning paper CP by about 50 mm to a second position apart from the first position by about 110 mm with respect to the recording material conveyance direction. As the recording material for the cleaning paper CP, an A4-sized cleaning sheet (trade name: "TAEHA", basis weight: 75 $g/m_2$) was used. In the cleaning mode, the unfixed toner image CT for cleaning is formed in the following manner. When the cleaning mode is executed, an image pattern for cleaning stored in ROM is developed. Then, by the same operation as the above-described image forming operation (normal image forming operation), the unfixed toner image for cleaning is formed on the cleaning sheet to prepare cleaning paper. That is, by using predetermined one or more image forming station of the four image forming stations provided at the image forming portion P, the following steps are performed in synchronism with the rotation of the intermediary transfer belt. That is, the charging step using the charging roller, the exposure step using the exposure device, the developing step using the developing device and the primary transfer step using the primary transfer roller are performed in synchronism with the rotation of the intermediary transfer belt. As a result, on the surface of the intermediary transfer belt, one or more toner images formed at the one or more image forming stations is transferred. Thus, the unfixed toner image, using one or more color, for cleaning is carried on the surface of the intermediary transfer belt. On the other hand, the recording material is fed from the feeding cassette by the feeding roller. The recording material is further conveyed to the secondary transfer nip with predetermined timing by the registration rollers. Then, by the secondary transfer roller, the unfixed toner image for cleaning on the surface of the intermediary transfer belt is transferred and carried on the recording material by the secondary transfer roller.

(Effect of Cleaning Mode)

A checking method of effects of the cleaning mode will be described. First, by using the image forming apparatus, the fixing device F and the toner A, in a low temperature and low humidity environment (15° C., 10% RH), 1000 sheets of the recording material were passed through the fixing device F at the recording material conveyance speed of 50 mm/sec and at the temperature-control temperature of 170° C. As the recording material, the A4-sized cleaning sheet (trade name: "TAEHA", basis weight: 75 $g/m_2$) was used. The reason why "TAEHA" is used as the recording material is that "TAEHA" contains a large amount of a filler such as calcium carbonate or talc which is liable to result in a paper powder rich contaminant on the surface of the pressing roller 22.

Then, the cleaning mode in this embodiment was executed, and the surface temperature (Th) of the fixing film 21 and the surface temperature Tp of the pressing roller immediately after passing of the recording material-through the fixing nip N during execution of idling of the fixing film 21 in the cleaning mode were measured. Specifically, the surface Th of the fixing film 21 and the surface temperature Tp of the pressing roller 22 were measured by using a surface radiation thermometer ("IT540", mfd. by HORIBA, Ltd.). After the execution of the cleaning mode, an occurrence of the paper powder rich contaminant on the surface of the pressing roller 22 was checked. Further, with respect to the cases where the temperature-control temperature during the idling of the fixing film 21 in the cleaning mode was set at 110° C., 90° C. and 80° C., the checking of the effect of the cleaning mode was performed in the same manner as that described above.

Next, image forming apparatuses in Comparative Embodiments 1 to 3 for comparison of the effect of the cleaning mode in this embodiment will be described.

Comparative Embodiment 1

The image forming apparatus in Comparative Embodiment 1 has the same constitution as that in Embodiment 1 except that the cleaning mode in the image forming apparatus in Embodiment 1 is not executed.

Comparative Embodiment 2

The image forming apparatus in Comparative Embodiment 2 has the same constitution as that in Embodiment 1 except that the temperature-control temperature during the idling of the fixing film 21 in the cleaning mode in the image forming apparatus in Embodiment 1 is changed to 70° C., 60° C. and 50° C. The checking of the effect of the cleaning mode was performed at the temperature-control temperatures of 70° C., 60° C. and 50° C.

Comparative Embodiment 3

The image forming apparatus in Comparative Embodiment 3 has the same constitution as that in Embodiment 1 except that the temperature-control temperature during the idling of the fixing film 21 in the cleaning mode in the image forming apparatus in Embodiment 1 is changed to 120° C., 130° C. and 140° C. The checking of the effect of the cleaning mode was performed at the temperature-control temperatures of 120° C., 130° C. and 140° C.

A result of the checking of the effect of the cleaning mode in the image forming apparatuses in Embodiment 1, Comparative Embodiment 1, Comparative Embodiment 2 and Comparative Embodiment 3 is shown in Table 1.

TABLE 1

| EMB. No. | TEMP. (° C.) *1 | SPEED (mm/sec) *2 | TIME (sec) *3 | CONTAMI-NANT *4 | Tp (° C.) | Th (° C.) |
|---|---|---|---|---|---|---|
| COMP. EMB. 1 | — | — | — | C | 30 | 27 |
| COMP. EMB. 2 | 50 | 50 | 60 | C | 42 | 36 |
| | 60 | 50 | 60 | C | 52 | 41 |
| | 70 | 50 | 60 | B | 61 | 51 |
| EMB. 1 | 80 | 50 | 60 | A | 67 | 60 |
| | 90 | 50 | 60 | A | 74 | 68 |
| | 100 | 50 | 60 | A | 82 | 75 |
| | 110 | 50 | 60 | A | 92 | 81 |
| COMP. EMB. 3 | 120 | 50 | 60 | B | 101 | 89 |
| | 130 | 50 | 60 | C | 110 | 96 |
| | 140 | 50 | 60 | C | 120 | 103 |

*1: "TEMP." represents the temperature-control temperature during idling.

*2: "SPEED" represents an idling speed.

*3: "TIME" represents an idling time.

*4: "CONTAMINANT" represents the paper powder rich contaminant and is evaluated at the following three levels.

A: The paper powder rich contaminant did not occur.

B: The paper powder rich contaminant somewhat occurred.

C: The paper powder rich contaminant occurred.

As shown in Table 1, in Embodiment 1, regardless of the temperature-control temperature during the idling of the fixing film 21 in the cleaning mode, the deposition of the paper powder rich contaminant on the surface of the pressing roller 22 was not substantially observed. Further, in Embodiment 1, the surface temperature Tp of the pressing roller 22, the deformation end point Tf2 of the toner and the flow start point Tf3 of the toner during the idling of the fixing film 21 during the execution of the cleaning mode satisfied a relationship of: Tf2≦Tp≦Tf3.

On the other hand, in Comparative Embodiments 1 to 3, the deposition of the paper powder rich contaminant was observed on the whole surface of the pressing roller 22. Further, in Comparative Embodiment 2, the surface temperature Tp of the pressing roller 22 and the deformation end point (Tf2) of the toner during the idling of the fixing film 21 during the execution of the cleaning mode provided a relationship of: Tp<Tf2. Further, in Comparative Embodiment 3, the surface temperature Tp of the pressing roller 22 and the flow start point Tf3 of the toner during the idling of the fixing film 21 during the execution of the cleaning mode provided a relationship of: Tf3<Tp.

From the comparison between Embodiment 1 and Comparative Embodiment 2, it is understood that the paper powder rich contaminant deposited on the surface of the pressing roller 2 is removed by the execution of the cleaning mode. Further, from the comparison of Embodiment 1 with Comparative Embodiments 2 and 3, it is understood that the following effect is achieved. That is, only when the surface temperature Tp of the pressing roller 22, the toner deformation end point Tf2 and the toner flow start point Tf3 satisfy the relationship of: Tf2≦Tp≦Tf3, the following effect can be obtained. That is, the paper powder rich contaminant deposited on the surface of the pressing roller 22 can be sufficiently removed by the execution of the cleaning mode.

A mechanism for removing the paper powder rich contaminant deposited on the surface of the pressing roller 22 in the cleaning mode will be described. In the paper powder rich contaminant on the surface of the pressing roller 22, the paper powder including the fibers of paper and the filler such as calcium carbonate adheres to another paper powder by the toner as an adhesive. The film heating type fixing device F is of a rotation drive type in which the fixing film 21 is rotated by a frictional force between the surface of the pressing roller 22 and the surface of the fixing film 21. In the rotation drive type, when the fixing film 21 is rotated by rotationally driving the pressing roller 22, the frictional force is also exerted on the paper powder rich contaminant deposited on the surface of the pressing roller 22.

In FIG. 3, (a) is an illustration showing a mechanism of the transfer of the paper powder rich contaminant from the pressing roller surface onto the fixing film surface, and (b) is an illustration showing a mechanism of removal of the paper powder rich contaminant transferred on the fixing film surface by the cleaning paper.

As in Embodiment 1, the surface temperature Tp of the pressing roller 22 is made not less than the toner deformation end point Tf2 and not more than the toner flow start point Tf3. As a result, the temperature of toner Ta in a paper powder rich contaminant St deposited on the surface of the pressing roller 22 is also not less than the deformation end point Tf2 and not more than the flow start point Tf3. For that reason, the toner Ta in the contaminant St on the surface of the pressing roller 22 is in a state such that the toner Ta is liable to be deformed to some extent but has substantially no flowability. In such a state, the pressing roller 22 is rotationally driven to apply the frictional force to the contaminant St deposited on the surface of the pressing roller 22. As a result, rigidity of the toner Ta in the contaminant St is low and therefore the paper powder Sa and the paper powder Sa in the contaminant St and the paper powder Sa and the toner Ta adhering on the surface of the pressing roller 22 are deformed by the frictional force, so that a contact area of the toner Ta and the paper powder Sa in the contaminant St is decreased in some cases. The bonding strength between the toner Ta and the paper powder Sa is proportional to the contact area between the toner Ta and the paper powder Sa. Therefore, when the contact area between the toner Ta and the paper powder Sa is decreased, the paper powder Sa in the contaminant St is dropped from the contaminant alone or in the form in which a part of the toner is deposited thereon. The paper powder Sa dropped from the contaminant St on the surface of the pressing roller 22 is less liable to be deposited again on the contaminant St at the surface of the pressing roller 22 even when the paper powder Sa is contacted again to the toner Ta in the contaminant St at the surface of the pressing roller 22 since the flowability of the toner in the contaminant is low and the contact area between the paper powder and the toner is less liable to be increased. For that reason, a part of the paper powder Sa which has not been deposited again on the contaminant St at the surface of the pressing roller 22 and which is dropped from the contaminant is transferred onto the surface of the fixing film 21 and is accumulated on the surface of the fixing film 21 ((a) of FIG. 3). Further, the contaminant St transferred from the surface of the pressing roller 22 onto the surface of the fixing film 21 is transferred from the surface of the fixing film 21 onto the cleaning paper CP passing (introducing) the cleaning paper CP through (into) the fixing nip N. That is, the contaminant St on the surface of the pressing roller 22 is transferred onto the surface (for carrying the unfixed toner image for cleaning) of the cleaning paper CP ((b) of FIG. 3) and then is discharged to the outside of the fixing device F.

On the other hand, as in Comparative Embodiment 2, in the case where the surface temperature Tp of the pressing roller 22 is lower than the toner deformation end point Tf2, the temperature of the toner in the contaminant is also lower than the toner deformation end point Tf2. For that reason, the toner in the contaminant on the surface of the pressing roller 22 is in a state such that the toner has very high rigidity and is like a complete solid. For that reason, even when the frictional force is applied to the contaminant on the surface of the pressing roller 22 by rotationally driving the pressing roller 22, the toner which bonds the paper powder to another paper powder in the contaminant on the surface of the pressing roller 22 is not substantially deformed, so that the paper powder is still fixed firmly on the contaminant at the surface of the pressing roller 22. For that reason, even when the frictional force is applied to the contaminant on the surface of the pressing roller 22 by rotationally driving the pressing roller 22 in the state in which the surface temperature Tp of the pressing roller 22 is lower than the toner deformation end point Tf2, the paper powder and the toner are less dropped from the contaminant deposited on the surface of the pressing roller 22. For that reason, the contaminant is less transferred from the surface of the pressing roller 22 onto the surface of the fixing film 21. Therefore, in the cleaning mode, in the case where the surface temperature Tp of the pressing roller 22 during the idling of the fixing film 21 is lower than the toner deformation end point Tf2, it is difficult to remove the contaminant from the surface of the pressing roller 22 by the execution of the cleaning mode.

Further, as in Comparative Embodiment 3, in the case where the surface temperature Tp of the pressing roller 22 is higher than the toner flow start point Tf3, the temperature of the toner in the contaminant on the surface of the pressing roller 22 is also higher than the toner flow end point Tf3. For that reason, the toner in the contaminant is in a state such that the toner has very high flowability and is like a viscous liquid. For that reason, even when the frictional force is applied to the contaminant on the surface of the pressing roller 22 by rotationally driving the pressing roller 22, the toner in the contaminant is deformed so as to enclose adjacent paper powder. Therefore, the contact area between the toner and the paper powder is less liable to be decreased and in many cases, the bonding strength between the toner and the paper powder is still great. For this reason, the paper powder and the toner are not readily dropped from the contaminant at the surface of the pressing roller 22. Further, even when the paper powder is dropped from the toner in the contaminant at the surface of the pressing roller 22, at the time of re-contact of the dropped paper powder with the toner in the contaminant at the surface of the pressing roller 22, the flowability of the toner in the contaminant is high and therefore the dropped paper powder is enclosed by the toner in the contaminant. For that reason, there is a high possibility that the paper powder enclosed by the toner in the contaminant is deposited again on the contaminant at the surface of the pressing roller 22. For that reason, even when the frictional force is applied to the contaminant on the surface of the pressing roller 22 by rotationally driving the pressing roller 22 in the state in which the surface temperature Tp of the pressing roller 22 is higher than the toner flow end point Tf3, the paper powder and the toner are less dropped from the contaminant deposited on the surface of the pressing roller 22. Further, the dropped paper powder is liable to be deposited again on the contaminant at the surface of the pressing roller 22 and therefore, the contaminant is less transferred from the surface of the pressing roller 22 onto the surface of the fixing film 21. Therefore, in the cleaning mode, in the case where the surface temperature Tp of the pressing roller 22 during the idling of the fixing film 21 is higher than the toner flow end point Tf3, it is difficult to remove the contaminant from the surface of the pressing roller 22 by the execution of the cleaning mode.

In the image forming apparatus in Embodiment 1, in the cleaning mode, the fixing film 21 is idled (rotated) for a predetermined time in a state in which the surface temperature Tp of the pressing roller 22 is controlled so that the surface temperature Tp is not more than the toner flow start point Tf3 and not less than the toner deformation end point Tf2. Thereafter, the cleaning paper CP is passed through the fixing nip N, so that the contaminant on the surface of the pressing roller 22 can be removed.

The reason why the idling of the fixing film 21 is started after the thermistor detection temperature becomes the normal temperature in the cleaning mode in the image forming apparatus in this embodiment is that the idling of the fixing film 21 can be started after the surface temperature Tp of the pressing roller 22 reliably becomes a temperature which is not more than the flow start point Tf3 of the toner. Even when the idling of the fixing film 21 is performed in the case where the surface temperature Tp of the pressing roller 22 is higher than the toner flow start point Tf3, as described in the result of Comparative Embodiment 3, the contaminant on the surface of the pressing roller 22 is not substantially transferred onto the surface of the fixing film 21. For that reason, the contaminant on the surface of the pressing roller 22 cannot be removed.

Further, in the case where the surface temperature Th of the fixing film 21 is not less than the flow start point Tf3, the toner in the contaminant transferred on the surface of the fixing film 21 is heated to the flow start point Tf3 or more, so that the bonding strength of the toner to the contaminant on the surface of the pressing roller 22 is increased. For that reason, in many cases, the contaminant transferred on the surface of the fixing film 21 is transferred again onto the pressing roller 22. Therefore, in the cleaning mode, during the idling of the fixing film 21, it is preferable that the surface temperature Th of the fixing film 21 is not more than the toner flow start point Tf3 as in Embodiment 1.

In the image forming apparatus in this embodiment, the controller C obtains the surface temperature Th of the fixing film 21 and the surface temperature Tp of the pressing roller 22 on the basis of the thermistor detection temperatures. Specifically, the controller C obtains the surface temperature Th of the fixing film 21 on the basis of the thermistor detection temperature by using a table or an operational expression prepared depending on a correlation between the thermistor detection temperature and the surface temperature Th of the fixing film 21. Similarly, the controller C obtains the surface temperature Tp of the pressing roller 22 on the basis of the thermistor detection temperature by using a table or an operational expression prepared depending on a correlation between the thermistor detection temperature and the surface temperature Tp of the pressing roller 22.

Further, also in the cleaning mode, the contaminant on the surface of the fixing film 21 is transferred onto the surface of the recording material to some extent without carrying the unfixed toner image for cleaning on the recording material. However, as in Embodiment 1, the case where the unfixed toner image for cleaning is carried on the cleaning paper is preferable since the contaminant on the surface of the fixing film 21 is smoothly transferred onto the recording material by the bonding strength of the toner of the unfixed toner image for cleaning. Further, also in the case where the unfixed toner image for cleaning is not carried on the recording material when the recording material is passed through the fixing nip in the cleaning mode, the surface temperature Th of the fixing film 21 may preferably be not less than the softening point Ts of the toner. When the surface temperature Th of the fixing film 21 is not less than the softening point Ts of the toner, the bonding strength of the toner, to the recording material, in the contaminant on the surface of the fixing film 21 can be increased. For that reason, when the recording material is passed through the fixing nip in the cleaning mode, the surface Th of the fixing film 21 may preferably be not less than the softening point Ts of the toner.

Embodiment 2

Another example of the image forming apparatus will be described. In this embodiment, the image forming apparatus and constituent elements of the image forming apparatus identical to those in Embodiment 1 are represented by the same reference numerals or symbols and will be omitted from redundant description. These are similarly applied to Embodiment 3, Embodiment 4 and Embodiment 5 described later.

The image forming apparatus in this embodiment has the same constitution as that in Embodiment 1 except that the toner different from that used in the image forming apparatus in Embodiment 1 is used and that the cleaning mode is different from that in Embodiment 1.

In this embodiment, toner B used in the image forming apparatus is constituted by a binder resin of a styrene-acrylic compound and a crystalline max of paraffin. The toner B has the deformation start point (Tf1) of about 51° C., the deformation end point (Tf2) of about 67° C., the flow start point (Tf3) of about 108° C., the flow end point (Tf4) of about 162° C. and the softening point (Ts) of about 135° C.

In cleaning mode in the image forming apparatus in this embodiment is the same as that in Embodiment 1 except that the temperature-control temperature during the idling of the fixing film 21 is changed to 120° C., 110° C., 100° C. and 90° C. The checking method of the effect of the cleaning mode is the same as that in Embodiment 1.

Next, image forming apparatuses in Comparative Embodiments 4 to 4 for comparison of the effect of the cleaning mode in this embodiment will be described.

Comparative Embodiment 4

The cleaning mode in Comparative Embodiment 4 is the same as that in Embodiment 1 except that the temperature-control temperature during the idling of the fixing film 21 in the cleaning mode in the image forming apparatus in Embodiment 1 is changed to 80° C., 70° C. and 60° C. The checking of the effect of the cleaning mode was performed at the temperature-control temperatures of 80° C., 70° C. and 60° C.

Comparative Embodiment 5

The cleaning mode in Comparative Embodiment 5 is the same as that in Embodiment 1 except that the temperature-control temperature during the idling of the fixing film 21 in the cleaning mode in the image forming apparatus in Embodiment 1 is changed to 150° C., 140° C. and 130° C. The checking of the effect of the cleaning mode was performed at the temperature-control temperatures of 150° C., 140° C. and 130° C.

A result of the checking of the effect of the cleaning mode in the image forming apparatuses in Embodiment 2, Comparative Embodiment 4 and Comparative Embodiment 5 is shown in Table 2.

TABLE 2

| EMB. No. | TEMP. (° C.) *1 | SPEED (mm/sec) *2 | TIME (sec) *3 | CONTAMINANT *4 | Tp (° C.) | Th (° C.) |
|---|---|---|---|---|---|---|
| COMP. EMB. 4 | 60 | 50 | 60 | C | 52 | 41 |
| | 70 | 50 | 60 | C | 61 | 50 |
| | 80 | 50 | 60 | B | 67 | 60 |
| EMB. 2 | 90 | 50 | 60 | A | 75 | 69 |
| | 100 | 50 | 60 | A | 84 | 76 |
| | 110 | 50 | 60 | A | 92 | 82 |
| | 120 | 50 | 60 | A | 103 | 91 |
| COMP. EMB. 5 | 130 | 50 | 60 | B | 112 | 95 |
| | 140 | 50 | 60 | C | 122 | 104 |
| | 150 | 50 | 60 | C | 131 | 114 |

*1: "TEMP." represents the temperature-control temperature during idling.
*2: "SPEED" represents an idling speed.
*3: "TIME" represents an idling time.
*4: "CONTAMINANT" represents the paper powder rich contaminant and is evaluated at the following three levels.
A: The paper powder rich contaminant did not occur.
B: The paper powder rich contaminant somewhat occurred.
C: The paper powder rich contaminant occurred.

As shown in Table 2, in Embodiment 2, regardless of the temperature-control temperature during the idling of the fixing film 21 during execution of the cleaning mode, the deposition of the paper powder rich contaminant on the surface of the pressing roller 22 was not substantially observed. Further, in Embodiment 2, the surface temperature Tp of the pressing roller 22, the deformation end point Tf2 of the toner and the flow start point Tf3 of the toner during the idling of the fixing film 21 during the execution of the cleaning mode satisfied a relationship of: Tf2≦Tp≦Tf3.

On the other hand, in Comparative Embodiments 4 and 5, the deposition of the paper powder rich contaminant was observed on the whole surface of the pressing roller 22. Further, in Comparative Embodiment 4, the surface temperature Tp of the pressing roller 22 and the deformation end point (Tf2) of the toner during the idling of the fixing film 21 during the execution of the cleaning mode provided a relationship of: Tp≦Tf2. Further, in Comparative Embodiment 5, the surface temperature Tp of the pressing roller 22 and the flow start point Tf3 of the toner during the idling of the fixing film 21 during the execution of the cleaning mode provided a relationship of: Tf3<Tp.

From the comparison of Embodiment 2 with Comparative Embodiments 4 and 5, it is understood that the following effect is achieved with respect to the toner B. That is, only when the surface temperature Tp of the pressing roller 22, the toner deformation end point Tf2 and the toner flow start point Tf3 satisfy the relationship of: Tf2≦Tp≦Tf3, the following effect can be obtained. That is, the paper powder rich contaminant deposited on the surface of the pressing roller 22 can be sufficiently removed by the execution of the cleaning mode.

Embodiment 3

Another example of the image forming apparatus will be described.

The image forming apparatus in this embodiment has the same constitution as that in Embodiment 1 except that the cleaning mode is different from that in Embodiment 1.

In the cleaning mode in this embodiment, the speed of the idling of the fixing film 21 was increased from 50 mm/sec in Embodiment 1 to 300 mm/sec, and the idling time was decreased from 60 seconds in Embodiment 1 to 10 seconds. That is, the rotational speed during the idling of the fixing film 21 for a predetermined time is not less than the rotational speed of the fixing film 21 when the unfixed toner image T is heat-fixed on the recording material S by the heat of the heater 23 while nip-conveying the recording material S carrying thereon the unfixed toner image T in the fixing nip N. Except for this point, the cleaning mode in this embodiment is the same as that in Embodiment 1. The checking method of the effect of the cleaning mode is the same as that in Embodiment 1.

Comparative Embodiment 6 to be compared with Embodiment 3 will be described.

Comparative Embodiment 6

In the cleaning mode in Comparative Embodiment 6, the speed of the idling of the fixing film 21 in the cleaning mode in Embodiment 1 is decreased from 50 mm/sec to 25 mm/sec, and the idling time of 60 seconds in Embodiment 1 is retained as it is. Except for this point, the cleaning mode in Comparative Embodiment 6 is the same as that in Embodiment 1.

The checking result of the effect of the cleaning mode in Embodiment 3 and Comparative Embodiment 6 will be described. In Embodiment 3, after the execution of the cleaning mode, the paper powder rich contaminant was not substantially observed on the surface of the pressing roller 22. On the other hand, in Comparative Embodiment 6, even after the execution of the cleaning mode, the deposition of the paper powder rich contaminant on the surface of the pressing roller 22 was observed.

In Embodiment 3, it was possible to remove the paper powder rich contaminant from the surface of the pressing roller 22 even when the idling time of the fixing film 21 in the cleaning mode is decreased. This is because the rotational speed of the pressing roller 22 is increased in order to increase that of the fixing film 21 and thus a difference in peripheral speed between the pressing roller 22 and the fixing film 21 to be rotated by the rotation of the pressing roller 22 is liable to be provided. As a result, a large frictional force is liable to act on the paper powder rich contaminant on the surface of the pressing roller 22, and the rotational speed of the fixing film 21 is increased and therefore the number of sliding per unit time between the surface of the pressing roller 22 and the surface of the fixing film 21 in the fixing nip N is increased. When a larger frictional force acting on the paper powder rich contaminant on the surface of the pressing roller 22, the paper powder is more liable to be dropped from the paper powder rich contaminant on the surface of the pressing roller 22. Further, with an increasing number of sliding per unit time between the surface of the pressing roller 22 and the surface of the fixing film 21 in the fixing nip N, the number of the paper powder dropped from the paper powder rich contaminant on the surface of the pressing roller 22 is increased. For that reason, as in Embodiment 3, by increasing the rotational speed of the fixing film 21 during the idling in the cleaning mode, it is possible to transfer a larger amount of the paper powder rich contaminant in a short time from the surface of the pressing roller 22 onto the surface of the fixing film 21.

In the image forming apparatus in this embodiment, a transfer efficiency of the paper powder rich contaminant from the surface of the pressing roller 22 onto the surface of the fixing film 21 is increased by increasing the rotational speed of the fixing film 21 during the idling in the cleaning mode. For that reason, it is possible to sufficiently remove the paper powder rich contaminant from the surface of the pressing roller 22 while reducing the time required for the execution of the cleaning mode. Further, as in Comparative Embodiment 6, when the rotational speed of the fixing film 21 in the cleaning mode is excessively slowed, the peripheral speed difference is less liable to be provided between the pressing roller 22 and the fixing film 21 to be rotated by the rotation of the pressing roller 22. For that reason, the frictional force does not readily act on the paper powder rich contaminant on the surface of the pressing roller 22, so that the paper powder is less liable to be dropped from the paper powder rich contaminant on the surface of the pressing roller 22. For that reason, the idling rotational speed of the fixing film 21 in the cleaning mode may preferably be 50 mm/sec or more. Further, the time required for the idling of the fixing film 21 in the cleaning mode varies depending on the idling speed of the fixing film 21 in the cleaning mode and an execution frequency of the cleaning mode. However, when a lowering in usability due to an increase in execution frequency of the cleaning mode is taken into consideration, the time required for the idling of the fixing film 21 in the cleaning mode may preferably be 10 seconds or more.

Embodiment 4

Another example of the image forming apparatus will be described.

The image forming apparatus in this embodiment has the same constitution as that in Embodiment 1 except that the cleaning mode is different from that in Embodiment 1.

In the cleaning mode in this embodiment, the speed of the idling of the fixing film 21 was increased from 50 mm/sec in Embodiment 1 to 300 mm/sec, and the idling time was decreased from 60 seconds in Embodiment 1 to 10 seconds. Then, the cleaning mode was executed every nip-conveyance of a predetermined number of sheets of the recording material S in the fixing nip N. Except for this point, the cleaning mode in this embodiment is the same as that in Embodiment 1.

In Embodiment 1, the cleaning mode was executed after the passing of 1000 sheets but in this embodiment, the cleaning mode was executed every passing of 100 sheets as the predetermined number of sheets of the recording material. The above cycle of "the passing of 100 sheets and the execution of the cleaning mode after the passing of 100 sheets" was executed 10 times, thus performing the passing of 1000 sheets in total. The paper powder rich contaminant on the surface of the pressing roller 22 after the passing of 1000 sheets was checked. The checking method of the effect of the cleaning mode is the same as that in Embodiment 1.

Comparative Embodiment 7 to be compared with Embodiment 4 will be described.

Comparative Embodiment 7

The cleaning mode in Comparative Embodiment 7 was executed only after the passing of 1000 sheets and then the paper powder rich contaminant on the surface of the pressing roller 22 was checked. Except for this point, the cleaning mode is the same as that in Embodiment 4.

The result of the checking of the effect of the cleaning mode in Embodiment 4 and Comparative Embodiment 7 will be described. In Embodiment 4, the paper powder rich contaminant on the surface of the pressing roller 22 was not substantially observed. On the other hand, in Comparative Embodiment 6, although the same cleaning mode as that in this embodiment is executed, the paper powder rich contaminant on the surface of the pressing roller 22 was observed. This is because the frequency of the execution of the cleaning mode is larger than that in this embodiment. As in Comparative Embodiment 7, even when only one cleaning mode is executed after the passing of 1000 sheets, the paper powder rich contaminant on the surface of the pressing roller 22 cannot be sufficiently removed. However, by executing the cleaning mode every passing of 100 sheets as in Embodiment 4, even when the rotational time of the fixing film 21 in the cleaning mode is short, it is possible to sufficiently remove the paper powder rich contaminant on the surface of the pressing roller 22.

By further increasing the execution frequency of the cleaning mode than that in this embodiment, it is possible to shorten the rotational time of the fixing film 21 in the cleaning mode. However, the cleaning paper passing frequency and a frequency of waiting for cooling until the surface temperature Tp of the pressing roller 22 becomes the normal temperature are increased by increasing the number of times of execution of the cleaning mode, so that a lowering in usability is remarkable. For that reason, it is desirable that the cleaning mode execution frequency is every 100 sheets or more. Further, in order to sufficiently ensure a removing performance of the paper powder rich contaminant on the surface of the pressing roller 22 every 100 sheets or more, the idling time of the fixing film 21 in the cleaning mode may desirably be 10 seconds or more.

Embodiment 5

Another example of the image forming apparatus will be described.

The image forming apparatus in this embodiment has the same constitution as that in Embodiment 1 except that the cleaning mode is different from that in Embodiment 1.

In the cleaning mode in this embodiment, the idling of the fixing film 21 was started with timing when the thermistor detection temperature was not more than the flow start point Tf3 of the toner A. Further, the temperature-control temperature of the fixing film 21 during the idling was set at 93° C. which was the flow start point Tf3 of the toner A. Except for this point, the cleaning mode in this embodiment is the same as that in Embodiment 1. The checking method of the effect of the cleaning mode is the same as that in Embodiment 1.

In Embodiment 5, the paper powder rich contaminant was not substantially observed at the surface of the pressing roller 22. In the fixing device F, the heat is transmitted from the heater 23 to the fixing film 21 and then is transmitted from the fixing film 21 to the pressing roller 22. For that reason, during the heat generation of the member 23 during the sheet passing, the temperature is higher in the (decreasing) order of the heater 23, the surface of the fixing film 21 and the surface of the pressing roller 22. Further, the order of the temperature is kept even after the sheet passing is ended and the heat generation of the heater 23 is completed. For that reason, when the thermistor detection temperature of the thermistor 26 for detecting the temperature of the heater 23 is not more than the flow start point Tf3 of the toner A, the surface temperature Tp of the pressing roller 22 and the surface temperature Th of the fixing film 21 are not more than the flow start point Tf3 of the toner A.

For that reason, when the idling of the fixing film 21 is started with timing when the thermistor detection temperature is not more than the flow start point Tf3 of the toner A, the idling of the fixing film 21 can be started from a state in which Tp<Th3 and Th<Tf3 are satisfied. In this state, when the temperature-control temperature of the heater 23 during the idling of the fixing film 21 is controlled so as to satisfy Tf2<Tp, it is possible to transfer the paper powder rich contaminant from the surface of the pressing roller 22 to the surface of the fixing film 21.

In the case where a temperature detecting member, for the second rotatable member, capable of detecting that the surface temperature Tp of the pressing roller 22 becomes not more than the flow start point Tf3 of the toner with reliability is mounted in the fixing device F, the idling of the fixing film 21 in the cleaning mode is executed with predetermined timing. That is, as in Embodiment 5, the idling of the fixing film 21 in the cleaning mode is executed with timing when the second rotatable member temperature detecting member such as the thermistor detects that the surface temperature Tp of the pressing roller 22 is not more than the toner flow start point Tf3. As a result, the time required for the execution of the cleaning mode is shorter than that in the case where the idling of the fixing film 21 in the cleaning mode is started after the thermistor detection temperature becomes the normal temperature as in Embodiments 1 to 4, thus being preferable. Further, also in the case where the temperature detecting member, for the first rotatable member, capable of detecting that the surface temperature Th of the fixing film 21 is not more than the flow start point Tf3 of the toner with reliability is mounted in the fixing device F, the idling of the fixing film 21 in the cleaning mode is executed with predetermined timing. That is, as in Embodiment 5, the idling of the fixing film 21 in the cleaning mode may also be executed with timing when the first rotatable member temperature detecting member such as the thermistor detects that the surface temperature Th of the fixing film 21 is not more than the toner flow start point Tf3. In other words, in the case where the detection temperature of at least one of the first rotatable member temperature detecting member and the second rotatable member temperature detecting member is not more than the toner flow start point Tf3, the fixing film 21 is idled for a predetermined time in the cleaning mode in Embodiment 5.

Other Embodiments

1) The cleaning mode may also be applied to the image forming apparatus in which the fixing device in which the pressing roller is rotated by the rotation of the fixing film is mounted. Or, the cleaning mode may be applied to the image forming apparatus in which the fixing device including the pressing roller and the fixing film which are independently rotated is mounted.

2) It is also possible to achieve similar action and effect even when the cleaning mode is applied to the image forming apparatus in which the fixing device of the heating roller type including the fixing roller (first rotatable member) and the pressing roller (second rotatable member) is used in place of the fixing device of the film heating type.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 105347/2010 filed Apr. 30, 2010, which is hereby incorporated by reference.

What is claimed is:

1. An image forming apparatus comprising:

an image forming portion for forming an unfixed toner image on a recording material; and a fixing portion for heat-fixing the unfixed toner image on the recording material while nip-conveying the recording material in a fixing nip, said fixing portion including a heater, a first rotatable member contactable to the unfixed toner image, and a second rotatable member contacted to the first rotatable member to form the fixing nip between the first rotatable member and the second rotatable member, wherein said image forming apparatus is capable of setting a cleaning mode in which said fixing portion is cleaned by a cleaning sheet while nip-conveying the cleaning sheet in the fixing nip, wherein when the cleaning mode is set, said image forming apparatus provides a period in which the first rotatable member and the second rotatable member are rotated in a state in which the heater is controlled so that a surface temperature Th of the first rotatable member immediately after passing through the fixing nip is kept within a temperature range of $Th \leqq Tf3$, wherein Tf3 is a flow start point of the toner and so that a surface temperature Tp of the second rotatable member immediately after passing through the fixing nip is within a temperature range $Tf2 \leqq Tp \leqq Tf3$, wherein Tf2 is a deformation end point of the toner, and wherein after a lapse of the period, the cleaning sheet is nip-conveyed in the fixing nip.

2. An apparatus according to claim 1, wherein the first rotatable member is an endless belt having an inner surface to which the heater is contacted.

3. An apparatus according to claim 1, wherein when the cleaning sheet is nip-conveyed in the fixing nip, said image forming apparatus controls the heater so that the surface temperature Th of the first rotatable member immediately after passing through the fixing nip is kept within a temperature range of $Ts \leqq Th$, wherein Ts is a softening point of the toner.

4. An apparatus according to claim 3, wherein when the cleaning mode is set, said image forming apparatus forms the cleaning sheet for carrying an unfixed toner image for cleaning by using said image forming portion.

* * * * *